US005344149A

United States Patent [19]

Miller

[11] Patent Number: 5,344,149

[45] Date of Patent: Sep. 6, 1994

[54] GOLF PUTTER

[76] Inventor: Charles J. Miller, 1 Jennings Ct., Westport, Conn. 06880

[21] Appl. No.: 54,054

[22] Filed: Apr. 26, 1993

[51] Int. Cl.[5] ..... A63B 53/04

[52] U.S. Cl. ..... 273/167 B; 273/167 F; 273/167 H; 273/169

[58] Field of Search ..... 273/167 R, 167 F, 167 B, 273/169, 167 H, 164.1, 167 J, 171, 172, 173, 77 R

[56] References Cited

U.S. PATENT DOCUMENTS

| | | | |
|---|---|---|---|
| Re. 19,178 | 5/1934 | Spiker | 273/169 X |
| D. 196,734 | 10/1963 | Solheim . | |
| D. 209,215 | 11/1967 | Long . | |
| D. 232,252 | 7/1974 | Cook . | |
| D. 306,629 | 3/1990 | Shearer | D21/219 |
| 1,467,714 | 9/1923 | Doerr | 273/168 X |
| 1,543,691 | 6/1925 | Beat | 273/167 F |
| 3,085,804 | 4/1963 | Pieper | 273/167 B X |
| 3,387,844 | 6/1968 | Shippee | 273/77 |
| 3,497,220 | 2/1970 | Scott | 273/81.3 |
| 4,240,636 | 12/1980 | Swenson | 273/169 |
| 4,314,701 | 2/1982 | Swanson | 273/164 |
| 4,325,553 | 4/1982 | Taylor | 273/167 F |
| 4,650,191 | 3/1987 | Mills | 273/169 X |
| 4,664,385 | 5/1987 | Macera | 273/167 B |
| 4,795,157 | 1/1989 | Bengriscutto | 273/169 X |
| 4,852,879 | 8/1989 | Collins | 273/164 |
| 4,881,739 | 11/1989 | Garcia | 273/164.1 |
| 4,913,438 | 4/1990 | Anderson | 273/164 |
| 5,014,992 | 5/1991 | McCallister | 273/164 |
| 5,016,882 | 5/1991 | Fujimura et al. | 273/167 H |
| 5,100,146 | 3/1992 | Antonious | 273/167 F |
| 5,211,401 | 5/1993 | Hainey | 273/169 X |

FOREIGN PATENT DOCUMENTS

| | | | |
|---|---|---|---|
| 2142248 | 1/1985 | United Kingdom | 273/167 G |

*Primary Examiner*—V. Millin
*Assistant Examiner*—Sebastiano Passaniti
*Attorney, Agent, or Firm*—Perman & Green

[57] ABSTRACT

A golf putter having a shaft and a head. The head has a main body with a ball-striking face that has a negative loft. The main body also has a weight distribution such that a majority of weight of the main body is located above a prime striking area on the ball-striking face.

16 Claims, 1 Drawing Sheet

5344149

GOLF PUTTER

BACKGROUND OF THE INVENTION

1. Field Of The Invention

The present invention relates to golf clubs and, more particularly, to a golf putter.

2. Prior Art

U.S. Pat. No. 3,497,220 discloses a golf club for putting with a weight attached to an upper portion of an S-shaped hosel which connects the rear of the heel to the shaft. U.S. Pat. No. 3,387,844 discloses various golf club head shapes with chambers. U.S. Pat. No. 4,314,701 discloses a putter club with a cylindrical mid portion. U.S. Pat. No. Des. 196,734; U.S. Pat. No. Des. 305,629; 5,100,146; 4,852,879; and 4,325,553 appear to show vertical ball striking faces. U.S. Pat. Des. 209,215; Des. 232,252; 4,240,636; 4,913,438; 5,014,992; and 5,016,882 appear to show inclined ball-striking faces with positive loft.

SUMMARY OF THE INVENTION

In accordance with one embodiment of the present invention a golf putter is provided comprising a shaft and a head. The head is connected to an end of the shaft. The head has a ball striking face with a negative loft.

In accordance with another embodiment of the present invention, a golf putter is provided comprising a shaft and a head. The head is connected to an end of the shaft. The head has a front ball striking face with a prime striking area for striking an equator of a golf ball. The head comprises a main body with a weight distribution such that a majority of weight of the head is located above the prime striking area.

In accordance with another embodiment of the present invention a golf putter head is provided comprising a main body and a ball striking face on a front of the main body. The main body has a general block shape. The ball striking face has a prime striking area for striking an equator of a golf ball. The main body has a weight distribution with a majority of weight of the main body being located above the prime striking area.

In accordance with another embodiment of the present invention a golf putter head is provided comprising a main body having a general block shape and a ball striking face on a front of the main body. The ball striking face has a negative pitch from the top of the face to a bottom of the face. The main body has a cavity therein such that a majority of weight of the main body is located above a prime striking area on the ball striking face.

BRIEF DESCRIPTION OF THE DRAWINGS

The foregoing aspects and other features of the invention are explained in the following description, taken in connection with the accompanying drawings, wherein.

DETAILED DESCRIPTION OF THE INVENTION

Figure 1:
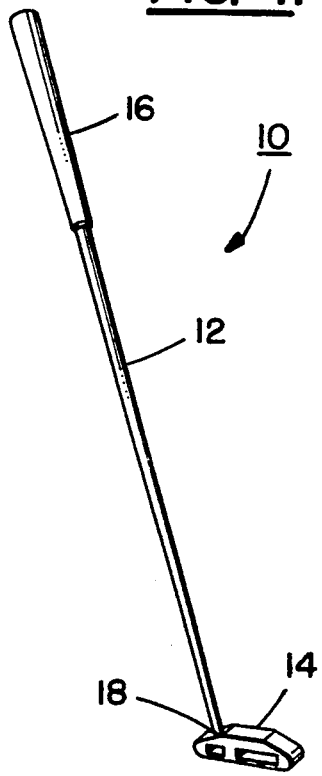
FIG. 1 is a perspective view of a golf putter incorporating features of the present invention.

Referring to FIG. 1, there is shown a perspective view of a golf putter 10 incorporating features of the present invention. Although the present invention will be described with reference to the embodiments shown in the drawings, it should be understood that features of the present invention could be embodied in various different forms of embodiment. In addition, any suitable size, shape or type of materials or elements could be used.

The putter 10 generally comprises a shaft 12 and a putter head 14. The shaft 12, in the embodiment shown, is straight with a handle 16 and an end 18 that is connected to the head 14 at an angle. The shaft 12 is preferably made of metal, but may be made of other material such as composite fibers. In alternate embodiments, any suitable type of shaft could be used.

Figure 2:
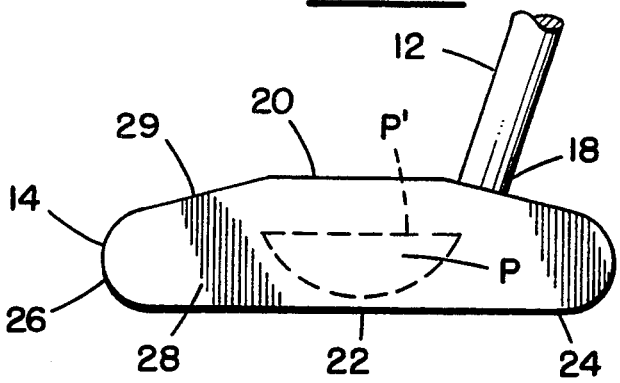
FIG. 2 is a front elevational view of the bottom of the golf putter shown in FIG. 1 showing the putter head and lower end of the shaft connected to the putter head.
Figure 3:
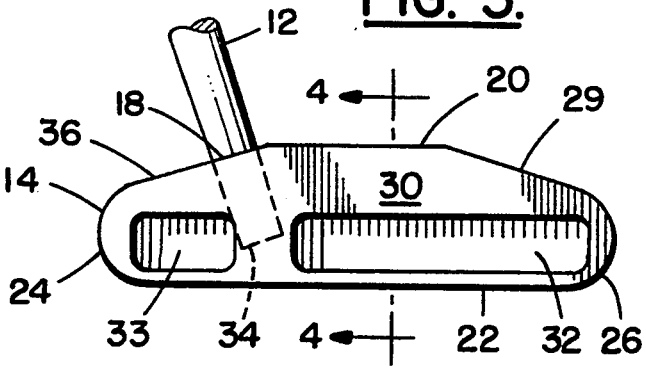
FIG. 3 is a rear elevational view of the putter head shown in FIG. 2.
Figure 4:
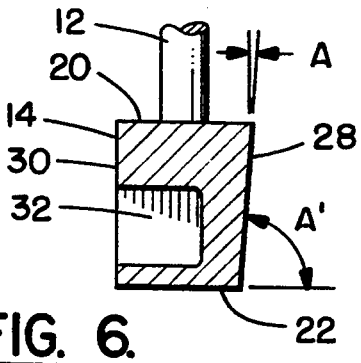
FIG. 4 is a cross sectional view of the putter head shown in FIG. 3 taken along line 4—4.

Referring also to FIGS. 2–4, the putter head 14 is shown enlarged. The head 14 is made of a suitable material such as brass or steel. However, any suitable type of material could be used. The head 14 has a main body 29 with a top 20, a bottom 22, a heel 24, a toe 26, a front ball-striking face 28, and a rear end 30. In the embodiment shown, the main body 29 has a general block shape. Two cavities 32, 33 extend into the main body 29 from the rear end 30. These two cavities are, generally located in the bottom section of the main body 29 to reduce the weight of the bottom section. A third cavity 34 extends into the main body 29 from a slanted surface 36 of the top 20. The end 18 of the shaft 12 is fixedly mounted in the third cavity 34. One feature of the present invention is the fact that the ball-striking face 28 has a negative loft. As used herein, the term "negative loft" is intended to mean that the ball-striking face 28 is angled or inclined inwardly down from the top 20 of the main body to the bottom 22 of the main body. To put it another way, the ball striking face 28 is angled upwardly and outwardly from the flat bottom 22 at an angle greater than 90°. The angle A of negative loft is illustrated in FIG. 4. In a preferred embodiment, the angle A of negative loft is about 1° to about 3° (i.e.: the angle A′ is about 89° to about 87°). However, any suitable type or degree of negative loft could be provided. In alternate embodiments, the ball-striking face could have a zero loft (i.e.: the ball-striking face would be perpendicular to the flat bottom 22) or, a positive loft similar to those patents described above as having positive loft.

Figure 5:
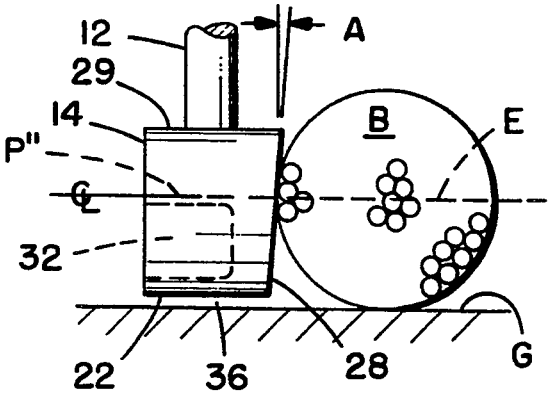
FIG. 5 is a schematic side elevational view of the bottom of the golf putter shown in FIGS. 1 thru 4 striking a golf ball on the ground.

Another feature of the present invention is in regard to weight distribution in the main body 29. Referring also to FIG. 5, there is shown a schematic side view of a golf ball B located on the ground G, such as on a putting green of a golf course. The head 14 is shown striking the ball B at the ball's equator E. The angle A is not sufficiently large to significantly move the point of contact C between the face 28 and ball B off of the ball's equator E. During normal use of the putter 10 the golfer needs to keep the bottom 22 of the head 14 slightly above the ground G in order to have a smooth swing. FIG. 5 shows this spacing or gap 36. Golf balls are all substantially the same size. The United States Golf Association (USGA) rules of golf limit the size of golf balls to a minimum size of 1.68 inches (42 mm) in diameter. Only one known golf ball manufacturer makes a golf ball with a size larger than 1.68 inches (42 mm) in diameter. That manufacturer makes golf balls with a diameter of 1.72 inches (43 mm). The remaining known golf ball manufacturers make their golf balls with a diameter of 1.68 inches (42 mm). The difference between the two sizes is only 0.04 inch (1 mm) in diameter; 0.02 inch (0.5 mm) in radius. The distance between the ground G and the ball's equator is thus either 0.84 inch (21 mm) or 0.86 inch (21.5 mm). In the preferred embodiment, the putter 10 is designed for use with the standard size balls (balls with the 1.68 inches diameter). However, the putter could be designed for use with any size golf ball. The main body 29 has been suitably sized and shaped to provide the point of contact C, if the putter is used correctly within the normal standards for using a putter, within a prime area P of contact on the face 28 as illustrated in FIG. 2. The prime area P is located within the putter's sweet spot and has an upper boundary P′ established by the maximum or highest location on the face 28 that the equator E could contact (again, using normal standards). Because the putter 10 is designed for use with the standard size golf balls, the upper boundary P′ is about 0.84 inch (21 mm) from the bottom 22. Preferably, because of the gap 36, the upper boundary P′ is less than 0.84 inch (21 mm) from the bottom of 22. A golfer tries to keep the gap 36 as small as possible to keep uniformity in putting shots. Normally, the gap 36 will be about 0.04 inch (1 mm) to about 0.1 inch (2.5 mm). Thus, the upper boundary P′ is preferably about 0.8 inch (20 mm) to about 0.74 inch (18.5 mm) from the bottom 22. The main body 29 is suitably sized and shaped such that a majority of weight of the main body 29 is located above the prime area P and, thus, is always located above the point of contact C. FIG. 5 illustrates the P″ as the centerline of weight distribution in the main body 29. The centerline P″ is aligned with or above the upper boundary P′. As used herein the description that a majority of weight of the main body is located above the prime area P is intended to mean that the centerline P″ of weight distribution is aligned with or above the upper boundary P′ of the prime area P. In an alternate embodiment, however, the centerline P″ of weight distribution could be located below the upper boundary P′. In a preferred embodiment, the centerline P″ of weight distribution is about 0.74 inch (18.5 mm) to about 0.80 inch (20 mm) from the bottom surface 22. However, in alternate embodiments, other suitable centerlines of weight distribution could be provided. In a preferred embodiment about 60% of the weight of the main body 29 is located above the upper boundary P′. However, in alternate embodiments, other weight distributions or ratios could be provided.

There is a basic difference between an ordinary golf shot (with a driver or iron) and a golf putt. The two types of swings basically have inverse functions. An ordinary non-putting golf shot is intended to cause the golf ball to become airborne and, when the ball is struck properly, create a back spin and/or a side spin on the ball. A putting golf shot is intended to cause the golf ball to remain on the ground and roll smoothly with a top spin. The present invention provides an improved putter head more adapted to cause the golf ball to both remain on the ground and initially roll with a top spin.

Preferably, the ball-striking face 28 has either a zero loft or a negative loft. This type of face helps to keep the ball on the ground and, does not put a back spin on the ball when initially hit. With a zero loft, the ball initially leaves the ball-striking face with a zero or slight top spin that increases as the ball travels along the ground, at least until the top spin matches the speed of the ball on the ground. With the negative loft of the present invention, the ball initially leaves the ball-striking face with a definite forward top spin. Preferably, the ball-striking face is suitably negatively angled or lofted to create an initial top spin, upon being hit. One of the purposes of the negative loft is to start the ball rolling with a forward top spin to allow the spin of the ball to match the speed of the ball on the ground as quickly as possible. In other words, to eliminate skidding of the ball on the ground as soon as possible. This reduction in skidding helps to make golf putts more uniform and controllable for the golfer. However, an even greater top spin could be provided by a more negatively angled loft.

Another feature of the present invention is that the weight distribution of the head main body 29 is suitably configured to also cause the golf ball to both remain on the ground and initially start to roll with a top spin. Because more weight of the main body 29 is located above the point of contact C with the ball B than below the point of contact, this weight distribution assists in creating an initial top spin on the ball and, assists in preventing the ball from becoming airborne. In alternate embodiments, the top heavy weight distribution of the main body could be used in conjunction with a ball-striking face having a positive loft or, a ball-striking face having a negative loft could be used in conjunction with a non-top heavy main body.

Figure 6:
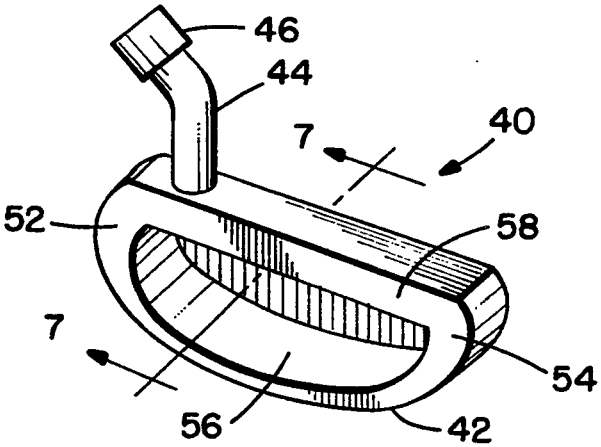
FIG. 6 is a perspective rear view of an alternate embodiment of the present invention.
Figure 7:
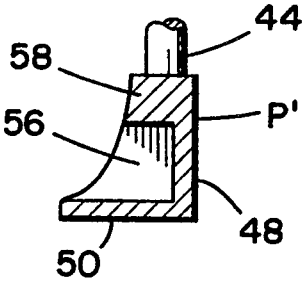
FIG. 7 is a cross sectional view of the putter head shown in FIG. 6 taken along line 7—7.

Referring now to FIGS. 6 and 7, there is shown an alternate embodiment of the present invention. In the embodiment shown, the putter head 40 has a main body 42 and a hosel 44. The main body 42 and hosel 44 are integrally connected to each other and perhaps integrally formed. An end of the hosel 44 has a shaft receiving socket 46 for connecting a shaft to the head 40. In the embodiment shown, the head 40 has a ball-striking face 48 with a zero loft (i.e.: the face 48 is perpendicular to the bottom 50 of the main body 42). However, in alternate embodiments, negative or positive lofts could be provided. The main body 42 has a weighted heel 52, a weighted toe 54, a center cavity 56, and a weighted top section 58. The weight of the main body 42 is suitably distributed such that a majority of weight of the main body 42 is located at and above the upper limit P′ of a prime area on the ball-striking surface 48. This embodiment is intended to illustrate that features of the present invention can be incorporated into other designs, such as the weighted heel and toe design putters.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A golf putter comprising:

a shaft; and a head connected to an end of the shaft, the head having a ball-striking face with a negative loft, the ball-striking face having a prime striking area for striking a golf ball, a centerline of weight distribution of the head being located above an upper boundary of the prime striking area, wherein the negative loft of the ball-Striking face and the centerline of the weight distribution of the head being located above the prime striking area additively combine to very quickly reduce skid of the golf ball after being hit by the putter.

2. A golf putter as in claim 1 wherein the negative loft is about 1° to about 3°.

3. A golf putter as in claim 1 wherein the head has a weighted heel and a weighted toe.

4. A golf putter as in claim 1 wherein the head has an angled hosel.

5. A golf putter comprising:

a shaft; and a head connected to an end of the shaft, the head having a front ball-striking face with a negative loft, a prime striking area for striking an equator of a golf ball and, a main body with a weight distribution such that a centerline of weight distribution of the head is located above an upper boundary of the prime striking area, wherein the negative loft of the ball-striking face and the weight distribution of the head additively combining to very quickly reduce the amount of skid of the golf ball after being hit by the putter.

6. A golf putter as in claim 5 wherein the main body has at least one cavity extending into the main body from a rear end of the head.

7. A golf putter as in claim 6 wherein the main body has two cavities extending into the main body from the rear end of the head.

8. A golf putter as in claim 7 wherein the main body has a third cavity that an end of the shaft is located in.

9. A golf putter as in claim 5 wherein the head has a weighted heel and a weighted toe.

10. A golf putter head comprising:

a main body having a general block shape; and a ball-striking face on a front of the main body, the ball-striking face having a prime striking area for striking an equator of a golf ball and a negative loft;

wherein the main body has a weight distribution with a majority of weight of the main body being located above the prime striking area such that a centerline of weight distribution is located above an upper boundary of the prime striking area and, the negative loft and majority of weight of the main body being located above the prime striking area additively combine to produce a quick top spin on a golf ball after being hit thereby substantially reducing skid of the golf ball on the ground and prevent the golf ball from leaving the ground.

11. A golf putter head as in claim 10 wherein the main body has at least one cavity extending into the main body from a rear end of the head.

12. A golf putter head as in claim 11 wherein the main body has two cavities extending into the main body from the rear end of the head.

13. A golf putter head as in claim 12 wherein the main body has a third cavity that an end of a shaft is located in.

14. A golf putter head as in claim 10 wherein the head has a weighted heel and a weighted toe.

15. A golf putter head comprising:

a main body having a general block shape; and a ball-striking face on the front of the main body having a negative pitch from a top of the face to a bottom of the face;

wherein the main body has a cavity therein such that a majority of weight of the main body is located above a prime striking area on the ball-striking face with a centerline or weight distribution located above an upper boundary of the prime-striking area, the negative pitch of the ball-striking face and the majority of weight of the main body being located above a prime striking area on the ball-striking face combining to produce a quick top spin on a golf ball after being hit to thereby substantially reduce skid of the golf ball on the ground.

16. A golf putter head as in claim 15 wherein about 60% of the weight of the main body is located above the prime striking area.

* * * * *